US005687583A

United States Patent [19]

Tunekawa et al.

[11] Patent Number: 5,687,583

[45] Date of Patent: Nov. 18, 1997

[54] AIR CONDITIONER HAVING OPENING/CLOSING MECHANISM FOR AIR-FLOW DIRECTION CHANGING BLADES

[75] Inventors: Syoji Tunekawa, Nitta-machi; Jyunichi Goya, Oizumi-machi; Fujio Suzuki, Ota; Yosuke Inagaki, Oizumi-machi; Shigeo Akaishi, Menuma-machi, all of Japan

[73] Assignee: Sanyo Electric Co., Ltd., Osaka, Japan

[21] Appl. No.: 618,469

[22] Filed: Mar. 15, 1996

[30] Foreign Application Priority Data

Apr. 27, 1995 [JP] Japan ..... 7-127164

[51] Int. Cl.[6] ..... F25D 17/04

[52] U.S. Cl. ..... 62/404; 62/267

[58] Field of Search ..... 62/404, 262, 263, 62/408; 454/201, 236, 358, 361

[56] References Cited

U.S. PATENT DOCUMENTS 3,305,162 2/1967 Hall, Jr. ..... 62/262

5,056,333 10/1991 Cho ..... 62/262

*Primary Examiner*—John M. Sollecito

*Attorney, Agent, or Firm*—Darby & Darby

[57] ABSTRACT

An air conditioner including an air intake vent, an air blow-off vent for blowing off air which has been heat-exchanged, air-flow direction changing blades which are disposed at the air blow-off vent and serves to change the air-flow (blow-off air) direction, an opening portion through the outside air is supplied from the outside into a room, a closing member (damper) for selectively closing the opening portion, and an open/close operation member which is disposed in a gap between the air-flow direction changing blades and allows the closing member to selectively open or close the opening portion. When the outside air is supplied through the opening portion into the room, a finger is inserted into the gap to move the open/close operation member in a direction along the gap, whereby an outside air work can be simply performed without detaching the front panel from the air conditioner.

8 Claims, 12 Drawing Sheets

AIR CONDITIONER HAVING OPENING/ CLOSING MECHANISM FOR AIR-FLOW DIRECTION CHANGING BLADES

BACKGROUND OF THE INVENTION

1. Field of the Invention

The present invention relates to an air conditioner having an opening portion through which the outside air is supplied, and a closing member which is capable of closing the opening portion.

2. Description of the Related Art

There has been generally known an air conditioner with a refrigeration cycle comprising a compressor, a condenser, a expansion device, an evaporator, etc. which are integrally built in the body of the air conditioner. Such an room type built-in air conditioner has a front panel which is secured to the body of the air conditioner, and the front panel is provided with an air intake opening (vent) and an air blow-off opening (vent). Further, plural air-flow direction changing blades are provided at the air blow-off opening so as to extend in a lateral (horizontal) or vertical direction. This type of air conditioner is designed to have an outside air supply means for supplying the outside air into a room, and the outside air supply means is generally provided with an outside-air supply opening and a closing member for closing the opening.

In the conventional air conditioner as described above, the closing member for closing the opening cannot be manipulated unless the front panel is detached from the front panel, so that an outside air supply work is very cumbersome.

On the other hand, if the air conditioner is designed so that the outside air supply work can be performed extremely simply, it makes the outside air supply work excessively easy and thus an user is liable to perform this work very often. Therefore, there occurs a problem that the outside air unintentionally continues to be supplied into the room.

SUMMARY OF THE INVENTION

An object of the present invention is to provide an air conditioner which enables an outside air supply work to be performed without detaching a front panel from the body of the air conditioner, and also prevents the outside air supply work to be extremely easily performed.

In order to attain the above object, according to a first aspect of the present invention, an air conditioner having a body, a front panel, plural air-flow direction changing blades which are provided at an air blow-off vent of the front panel so as to extend in a horizontal direction, and an opening portion for supplying the outside air into a room, is characterized by including an open/close operation member which is provided to an operation portion of the body so as to confront the air blow-off opening (vent) of the front panel and so that it can be manipulated through a gap between the plural air-flow direction changing blades from the outside of the air conditioner, and a closing member which is linked to the open/close operation member and serves to selectively open or close the opening portion in accordance with an operation state of the open/close operation member.

In the air conditioner as described above, the operation portion is formed with a slit, and the open/close operation member is designed to project forwardly through the slit of the operation-portion, the outside air supply opening portion being selectively opened or closed through the closing member by manipulating the open/close operation member from the outside of the air conditioner through the gap between the plural air-flow direction changing blades.

In the air conditioner as described above, the open/close operation member is designed to project forwardly from the operation portion along the slit and to be reciprocatively movable in a horizontal direction through the manipulation of the open/close operation member from the outside of the air conditioner through the gap between the plural air-flow direction changing blades.

In the air conditioner as described above, the open/close operation member comprises an operation rod which is secured to the operation portion so as to be reciprocatively movable along the slit of the operation portion, and a wire having one end linked to the operation rod and the other end linked to the closing member, wherein the rod is horizontally operated from the outside through the gap between the plural air-flow direction changing blades and the horizontal operation of the rod is transmitted to the closing member through the wire to perform a selective closing operation of the opening portion.

In the air conditioner as described above, the operation rod comprises a pin or a lever.

According to a second aspect of the present invention, a room type built-in air conditioner in which an indoor-side air conditioning portion including an indoor heat exchanger for performing heat exchange at an indoor side, an indoor air-blowing fan for blowing the air into a room and a front panel having plural air-flow direction changing blades which are provided at an air blow-off opening (vent) so as to extend horizontally, and an outdoor-side air conditioning portion including an outdoor heat exchanger for performing heat exchange at an outdoor side, a compressor for compressing refrigerant and an outdoor air-blowing fan for blowing off the air to the outside, are integrally fabricated in an outer case, and the indoor-side air conditioning portion and the outdoor-side air conditioning portion are separately sectioned by a partitioning plate, characterized by including an outside air supply opening portion which is provided to the partitioning plate and serves to supply the outside air into a room, an open/close operation member which is provided to an operation portion of the indoor-side air conditioning portion so as to confront the air blow-off vent of the front panel and so that it can be manipulated from the outside of the air conditioner through a gap between the plural air-flow direction changing blades, and a closing member which is linked to the open/close operation member and serves to selectively open or close the outside air supply opening portion in accordance with an operation state of the open/close operation member.

In the air conditioner as described above, the operation portion is formed with a slit, and the open/close operation member is designed to project forwardly through the slit of the operation portion, the outside air supply opening portion being selectively opened or closed through the closing member by manipulating the open/close operation member from the outside of the air conditioner through the gap between the plural air-flow direction changing blades.

In the air conditioner as described above, the open/close operation member is designed to project forwardly from the operation portion along the slit and to be reciprocatively movable in a horizontal direction through the manipulation of the open/close operation member from the outside of the air conditioner through the gap between the plural air-flow direction changing blades.

In the air conditioner as described above, the open/close operation member comprises an operation rod which is secured to the operation portion so as to be reciprocatively movable along the slit of the operation portion, and a wire having one end linked to the operation rod and the other end linked to the closing member, wherein the rod is horizontally operated from the outside through the gap between the plural air-flow direction changing blades and the horizontal operation of the rod is transmitted to the closing member through the wire to perform a selective closing operation of the opening portion.

In the air conditioner as described above, the operation rod comprises a pin or a lever.

According to the air conditioner of the present invention, the outside air supply opening portion can be opened to supply the outside air into the room by inserting fingers through a gap between the plural air-flow direction changing blades to manipulate the open/close operation member (to move the open/close operation member in the horizontal (lateral) direction). Therefore, the outside air supply work can be simply performed without detaching parts such as a front panel, etc. from the air conditioner. In addition, the open/close operation member is disposed not to be easily noticed, so that it can be prevented from being easily handled by everybody.

DETAILED DESCRIPTION OF THE PREFERRED EMBODIMENT

A preferred embodiment according to the present invention will be described hereunder with reference to the accompanying drawings. The following description is made on an outer case where the present invention is applied to an air conditioner, however, the same effect can be obtained in other cases where the present invention is applied to other types of air conditioners.

Figure 1:
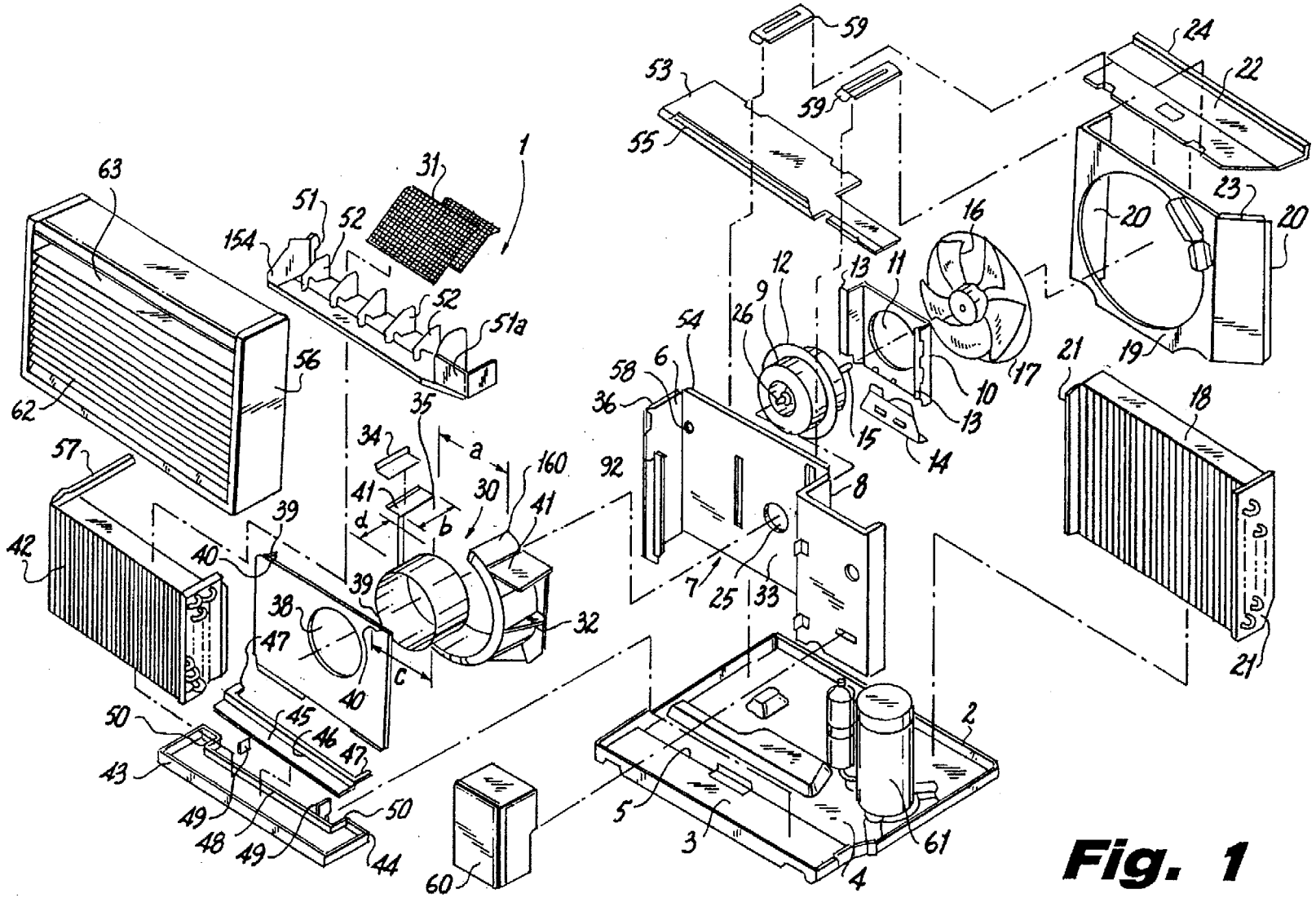
FIG. 1 is an exploded perspective view showing a room type built-in air conditioner of an embodiment of the present invention.

In FIG. 1, an air conditioner according to the present invention includes a body 1, and an outer case in which the body 1 is inserted. Reference numeral 2 represents a bottom plate which is formed with a stepped portion 5 so that a front portion 3 thereof is higher by one step than a rear portion 4. reference numeral 6 represents a partitioning plate mounted on the bottom plate, and the bottom plate 2 is divided by the partitioning plate 5 into an indoor side chamber 7 and an outdoor side chamber 8.

Reference numeral 9 represents a fan motor, and reference numeral 10 represents a mounting plate for the fan motor. A flange 12 of the fan motor 9 is secured to one side 11 of the mounting plate 10. A leg 13 of the mounting plate 10 is mounted on the outdoor chamber 8 of the partitioning plate 6. Reference numeral 14 represents a reinforcing plate for the mounting plate 10. reference numeral 15 represents one end portion of a drive shaft of the fan motor 9, to which a propeller fan 16 is secured. Reference numeral 17 represents a slinger ring. Drain stocked in the rear portion 4 of the bottom plate 2 is sprayed by rotation of the slinger ring 17 so as to splash the drain to an outdoor heat exchanger 18.

Reference numeral 19 represents a fan casing for the propeller fan 16, and both left and right members 20 are secured to the left and right end plates 21 respectively, of the outdoor heat exchanger 18. Reference numeral 22 represents an outdoor side top plate, which is secured to an upper edge 23 of the fan casing 19 to cover the outdoor heat exchanger 18. Reference numeral 24 represents a seal material, which is attached to the rear edge of the outdoor side top plate 22.

Figure 2:
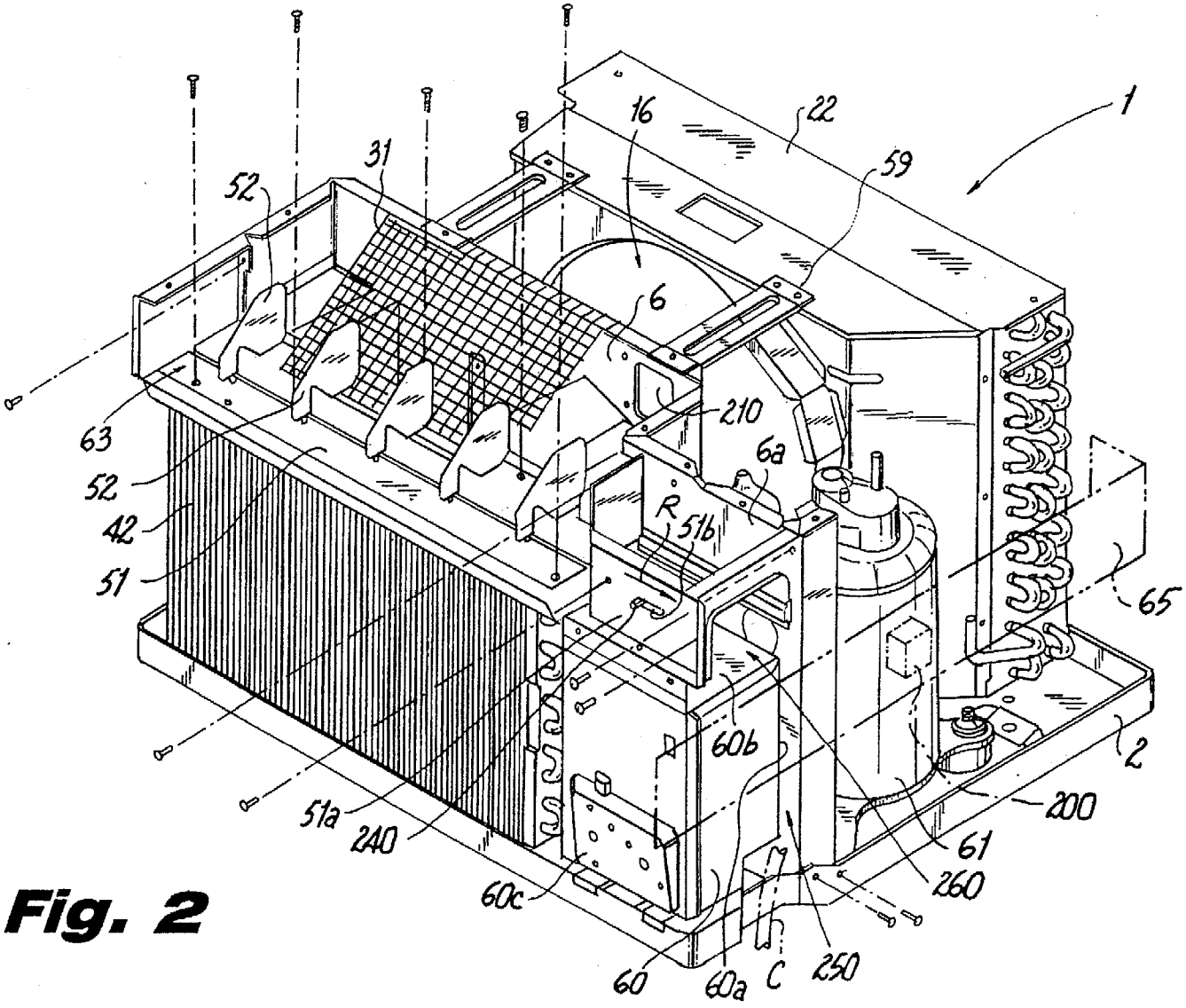
FIG. 2 is a perspective view showing the body of the air conditioner of the embodiment of FIG. 1.

A hole 25 is provided in the partitioning plate 6 through which the other end portion of the drive shaft 26 of the fan motor 9 extends. Another opening 210 through which the outside air is selectively supplied from the outside into a room is formed in the partitioning plate 6 as shown in FIG. 2, and it will be described later in more detail.

Reference numeral 27 represents a centrifugal fan mounted on the drive shaft 26. Reference numeral 28 represents a fan casing (scroll) of the fan, and it has a vent opening 29 at its front portion and an air blow-off (air discharge) opening 30 at its upper portion. That is, the fan casing 28 has a nose portion 160 and a scroll portion 161 that are integrally formed. A vent opening is formed in the front portion of the fan casing 28 and an air blow-off (air discharge) opening in the upper portion of the fan casing 28, the two openings merging to form a single continuous opening.

Reference numeral 31 represents a wire net to cover the air blow-off opening 30. The fan casing 28 has a flange 32 (back portion) mounted to the indoor side 33 of the partitioning plate 6 and secured to the partitioning plate 6 by means of a screw (not shown). The size of the air blow-off opening 30 of the fan casing 28 (i.e., the width a and the depth b of the air blow-off opening 30) is set to be larger than that of the centrifugal fan 27 (i.e., the diameter c and the thickness d of the centrifugal fan 27) so that the centrifugal fan may be removed from the air blow-off opening 30.

Reference numeral 34 represents a pipe cover, one end of which is secured to an end 35 on the opposite nozzle side of the fan casing 28 while the other end thereof is secured to a left edge 36 of the partitioning plate 6.

Reference numeral 37 represents a plate mounted on the front portion of the fan casing 28, and it is formed with an intake hole 38. Reference numeral 39 represents a mounting piece which is formed by rearwardly bending a part of an upper edge of the mounting plate 37, and the mounting piece has a mounting hole 40 formed therein. When the mounting plate 37 is moved downwardly along the front surface of the fan casing 28, the mounting hole 40 of the mounting piece 39 is inserted into a pin 41 on the upper surface of the fan casing 28. Thereby, the mounting plate 37 is secured to the front surface of the fan casing 28, and an intake hole (bell-mouth) 38 is aligned with the opening of the centrifugal fan 27. Reference numeral 42 represents a heat exchanger which is mounted in front of the fan casing 28 leaving a distance larger than a thickness d of the centrifugal fan. A distance projecting toward the front side of the motor shaft for rotatably supporting the centrifugal fan is set to be smaller than a distance between the rear surface of the heat exchanger and the front surface of the centrifugal fan. Accordingly, when the condition of the centrifugal fan 27 is to be inspected, the mounting plate 37 is drawn upwardly, and thereafter a screw driver is inserted into a hole 150 of the plate of the centrifugal fan 27 to turn and loosen a screw 152 of a boss 151 to remove it from the drive shaft 26 of the fan motor 9. After the centrifugal fan 27 is moved slightly aside (a gap 153 between the indoor heat exchanger 42 and the mounting plate 37), the centrifugal fan 27 is raised from the air blow-off opening 30 of the fan casing 28. In this manner, inspecting of the centrifugal fan 27 is carried out simply (see FIG. 3).

Referring to FIG. 1, reference numeral 43 represents a drain pan made of foamed styrol placed in the front portion 3 of the bottom plate 2, and a drain opening 44 intercommunicates with the outdoor side 8 through a lower cut opening (not shown) of the partitioning plate 6. Reference numeral 45 represents a heat shield plate laid at the rear of the drain pan 43, and a riser member 46 and a rear member 47 of the heat shield plate 45 cover a rise edge 48 of the drain pan 43.

Reference numeral 49 represents a piece of aluminum tape, which is attached to a riser wall 50 of a corner portion of the drain pan 43. Accordingly, a part of the radiant heat from an electric heater (not shown in FIG. 1) mounted on the front surface of the mounting plate 37 is intercepted by the heat shield plate 45 and the aluminum tape 49 to suppress the heat to be transmitted to the drain pan 43 made of foamed styrol to prevent the drain pan 43 from being thermally deformed. The indoor heat exchanger 42 is placed on the drain pan 43. A refrigerant pipe 57 connected to the indoor heat exchanger 42 extends around (leftwardly) the fan casing 28 and is inserted into a pipe hole 58 of the partitioning plate 6. A pipe cover 34 is arranged above the refrigerant pipe 57. Reference numeral 51 represents an air blow-off diffuser member arranged above the indoor heat exchanger 42, having longitudinal blades 52 arranged on a plate 154. This plate 154 covers the gap 153 between the heat exchanger 42 and the mounting plate 37, and is mounted thereover.

Figure 4:
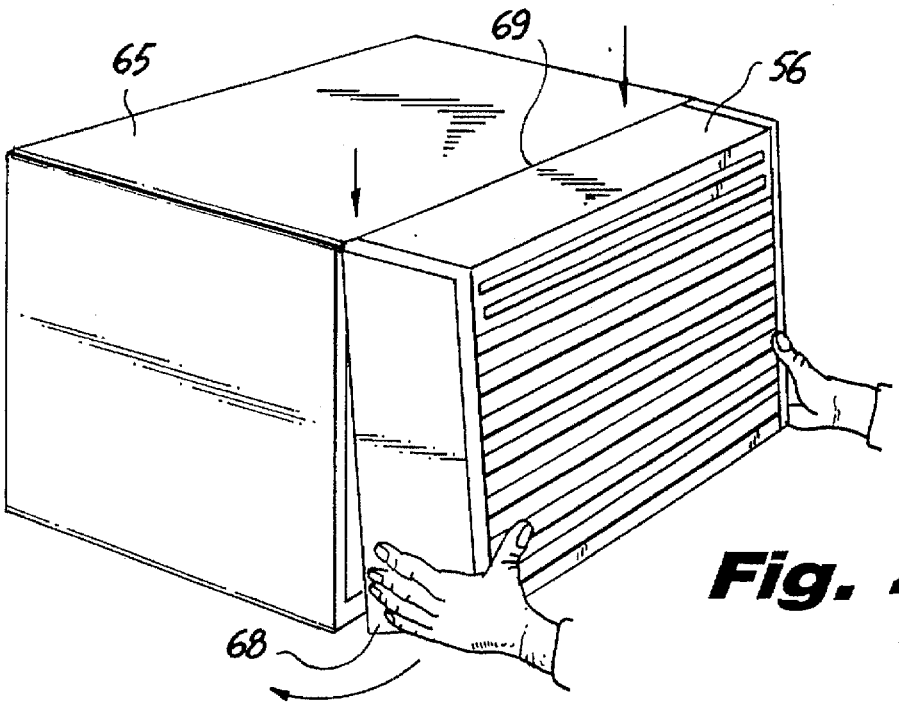
FIG. 4 is a perspective view showing a mount state of a front panel on the air conditioner of the embodiment.
Figure 4A:
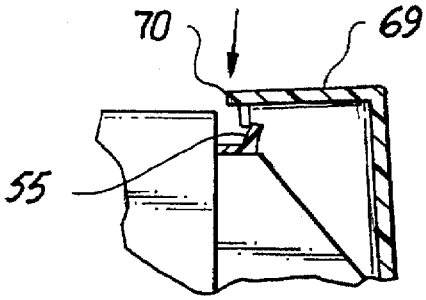
FIG. 4A is a detailed view of the mounting of a front panel onto the air conditioner.

Reference numeral 53 represents an indoor side top plate secured to an upper edge 54 of the partitioning plate 6, and a holding (fixing) member 55 is provided on the upper surface of the top plate 53 (see FIG. 4A). A front panel 56 is held by the holding member 55. When the indoor heat exchanger 20 is to be checked, a part of the refrigerator pipe is cut within the outdoor chamber 8, and the refrigerant pipe 57 extending from the indoor heat exchanger 42 is straightened. Next, when the indoor top plate 53, the air (blow-off) diffuse member 51 and the pipe cover 34 are removed, the refrigerant pipe 57 is positioned sideward of the fan casing 28 while penetrating through the pipe hole 58 of the partitioning plate 6. Accordingly, when the indoor heat exchanger 42 is drawn upwardly and thereafter the indoor heat exchanger 42 is drawn obliquely forwardly, the indoor heat exchanger 42 can be removed without removing the fan casing 28.

Reference numeral 59 represents a flat-plate fitting which connects the upper edge 54 of the partitioning plate 6 with the outdoor top plate 22. Reference numeral 60 represents an electric controller box which is secured to the indoor side of the partitioning plate 6.

Reference numeral 61 represents a compressor which is mounted on the rear portion 4 of the bottom plate 2. The front panel 56 is provided at the lower portion with an intake grill 62 and at the upper portion with an air supply opening (air discharge opening) 63. Reference numeral 64 represents movable blades for changing the air-flow direction (hereinafter referred to as "lateral blades") arranged on the air supply opening 63. The air supply opening 63 of the front panel is oriented horizontally. The horizontal orientation of the air supply opening 63 is based on the assumption that the air conditioner of this embodiment is mounted at a high position on a room wall. If the air conditioner is mounted at a low position on a room wall, the air supply opening 63 is preferably oriented slightly obliquely upwardly.

FIG. 2 is a perspective view showing the body 1 in the assembled state (except the front panel 56). In FIG. 2, reference numeral 65 represents an outer case for the body 1, and reference numeral 200 represents a pad made of polyethylene attached to the inside of the outer case 65. The pad 200 is positioned sideward of the compressor 61. Accordingly, even if the compressor 61 tends to vibrate abnormally as when the air conditioner has fallen or the like during transportation, this vibration is absorbed by the pad 200. It is to be noted that the body 1 can be shipped even when the case 65 is removed. In this case, a temporary cover in place of the outer case 65 is mounted on this unit. A pad made of foamed styrol is attached to the inside of the cover, and the abnormal vibration of the compressor 61 is absorbed by the pad. When the compressor is installed, the cover as well as the pad are removed.

Figure 3:
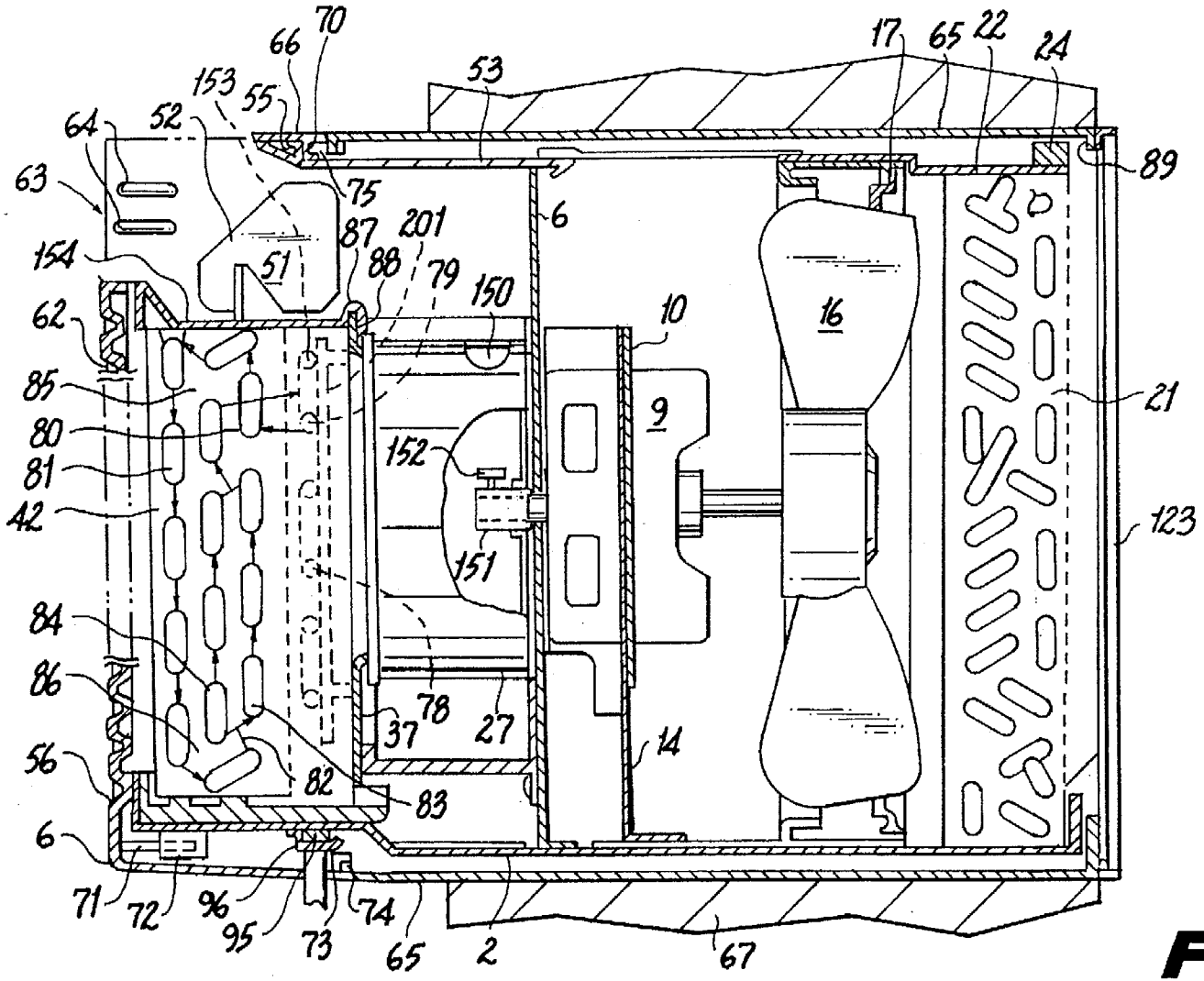
FIG. 3 is a longitudinal sectional view of the air conditioner of the embodiment.

FIG. 3 is a longitudinal sectional view of an air conditioner 66. The outer case 65 is mounted on so as to penetrate through the indoor wall 67. The body 1 shown in FIG. 2 is inserted into the case 65 from the indoor side. Thereafter, the lower portion 68 of the front panel 56 is moved as shown in FIG. 4, the projecting member 70 of the upper portion 69 of the front panel 56 is brought into engagement with the engaging member 55, and the engaging member 71 of the lower portion 68 is inserted into and locked at a receiver 72 of the bottom plate 2 (FIG. 3). When the front panel 56 is mounted in the manner as described above, the rear edge 73 of the front panel 56 abuts against the front edge 74 of the case 65 so that the surface of the case 65 is registered with the surface of the front panel 56.

Figure 5:
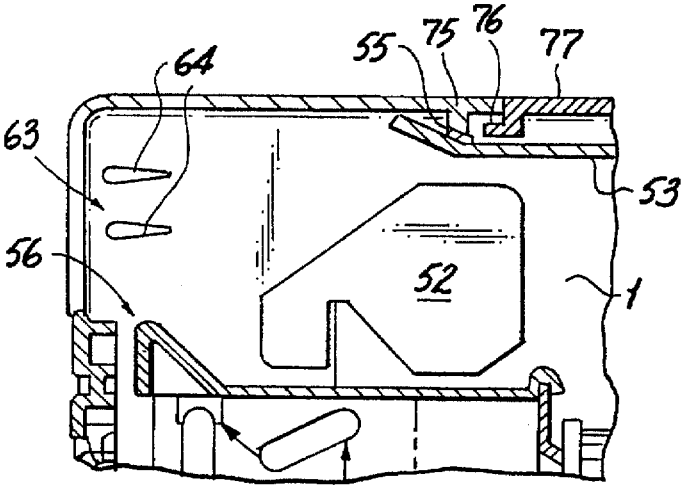
FIG. 5 is a diagram showing a different mount state of the front panel.

The projecting member 70 of the front panel 56 is provided inwardly from the rear edge 73 of the front panel 56, and a space 75 is formed around the rear edge 73. Since the space 75 is formed as described above, when the body 1 is inserted in another type outer case 77 having a projection 76 at the front edge as shown in FIG. 5 and the front panel 56 is brought into engagement with the engaging member 55, the projection 76 is positioned to be located in the space 75 of the front panel 56. The front panel 56 is at the same level as the other outer case 77. In other words, each of the outer case 77 having a projection on the front edge thereof (see FIG. 5) or the outer case 65 having no projection 76 on the front edge thereof (see FIG. 3) may have the front panel 56 mounted thereon.

Referring to FIG. 3, reference numerals 78 and 79 represent a heater and a fuse thereof, respectively, which are secured to the mounting plate 37 through a support frame 201. The indoor heat exchanger 42 functions as an evaporator, and a refrigerant flows as indicated by solid arrows in FIG. 3. More specifically, a refrigerant at a low temperature which is reduced in pressure by a pressure reducer (not shown) first flows into an downstream pipe 80, and thereafter flows in an inverted U-shape along the upper portion 85 within the heat exchanger into an upstream pipe 81. The refrigerant flows within the upstream pipe 81 from top to bottom, and is divided at the lower portion thereof into two flows by a special bend (cheese) 82 so that they flow into a downstream pipe 83 and an intermediate pipe 84. After they have been merged at the upper portion, they are returned to the compressor from the upper portion.

The low-temperature refrigerant is first made to flow in an inverted U-shaped fashion at the upper portion 85 of the indoor heat exchanger 42 because the heat-exchanger rate at the upper portion 85 is made to increase more than that at the low portion 86, whereby the air having passed through the upper portion 85 of the indoor heat exchanger 42 is cooled and lowered in temperature more than the air 86 having passed through the lower portion. Accordingly, the air having such a low temperature flows into a protective device (fuse) 79 of the heater 78, so that dew is prevented from sticking to the protective device 79.

Accordingly, when the heater 78 is energized in a heating operation, it is possible to prevent the heater 78 from being abnormally heated.

The rear edge 87 of the air blow-off member 51 is formed in an inverted U-shape so that the upper edge 88 of the mounting plate 37 is fitted into the rear edge 87 of the air blow-off member 51. The upper edge 88 of the mounting plate 37 is locked by the air blow-off member 51, and the mounting plate 37 and the air blow-off member 51 are actively combined with each other so that the air which his blown off from the air blow-off opening 30 of the fan casing 28 does not leak in and between the mounting plate 37 and the air blow-off member 51.

When the body 1 is put into the outer case 65, the seal 24 attached to the outdoor side top plate 22 moves close to the rear edge 89 of the outer case 65. The seal 24 is made close to the rear edge 89 of the outer case 65 as described above because the air blown off from the outdoor heat exchanger 21 is greatly suppressed to enter a gap between the outer case 65 and the outdoor side top plate 22.

Figure 6:
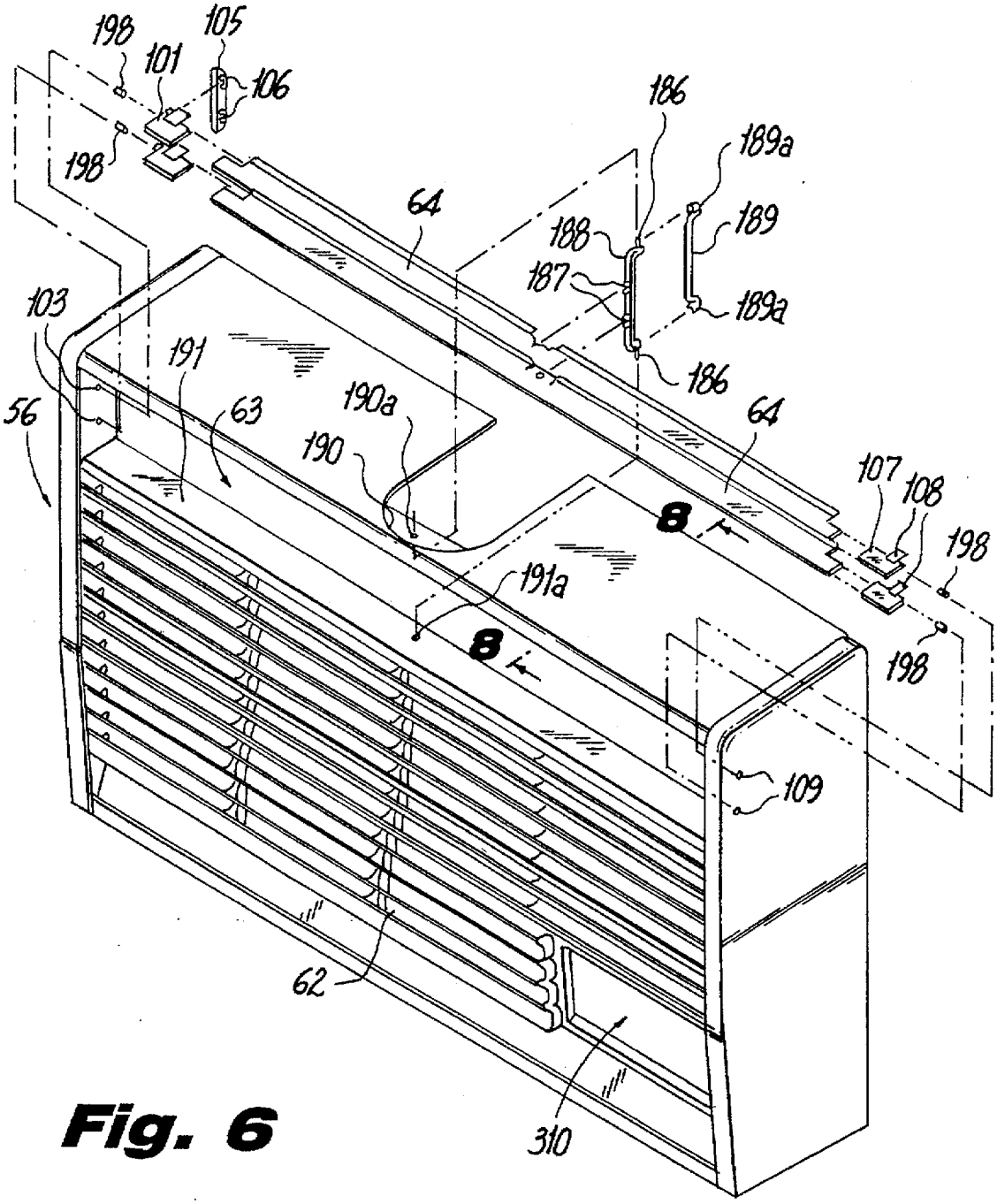
FIG. 6 is a perspective view showing the front panel.
Figure 7:
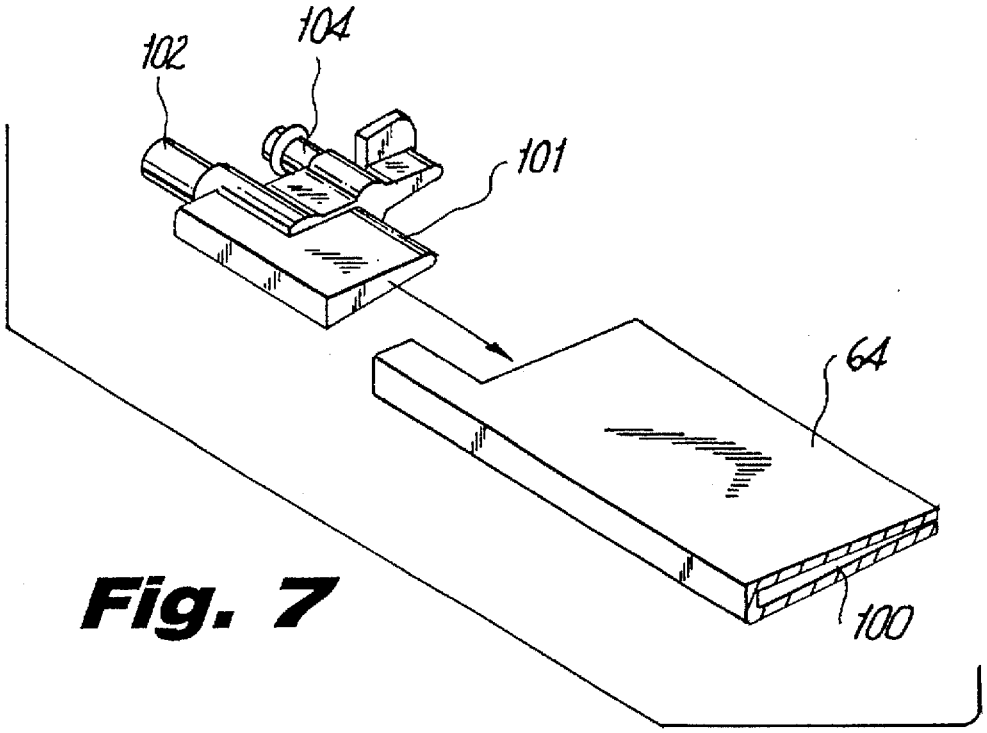
FIG. 7 is a perspective view a securing member of lateral blades at an air blow-off vent of the front panel.

FIG. 6 is a perspective view showing the front panel 56 of FIG. 1, and FIG. 7 is a perspective view showing a fitting member for the lateral blades at the air blow-off opening of the front panel.

Each of the lateral blades 64 arranged at the air supply opening 63 is formed by folding a metal plate so that a space 100 is formed therein as shown in FIG. 7. Reference numeral 101 represents a left support member which is formed of synthetic resin and is engagedly inserted in the space 100 of each lateral blade 64. Reference numeral 102 represents a left shaft (one shaft), which is inserted into a left-side support hole 103 of the air supply opening 63 through part 198. Reference numeral 104 represents an interlocking shaft which is engaged with a cutout 106 of an interlocking plate 105. Reference numeral 107 represents a right support member which is formed of synthetic resin, and engagedly inserted into the space 100 of each lateral blade 64. Reference numeral 108 represents a right shaft (other shaft), and it is formed in a cylindrical shape and inserted into a right-side support hole 109 through a part 198. The outer diameter of the right shaft 108 is set to be smaller than the inner diameter of the right-side support hole 109 of the air supply opening 63. With this construction, the lateral blades 64 are freely rotatably supported in the air blow-off opening.

Figure 14:
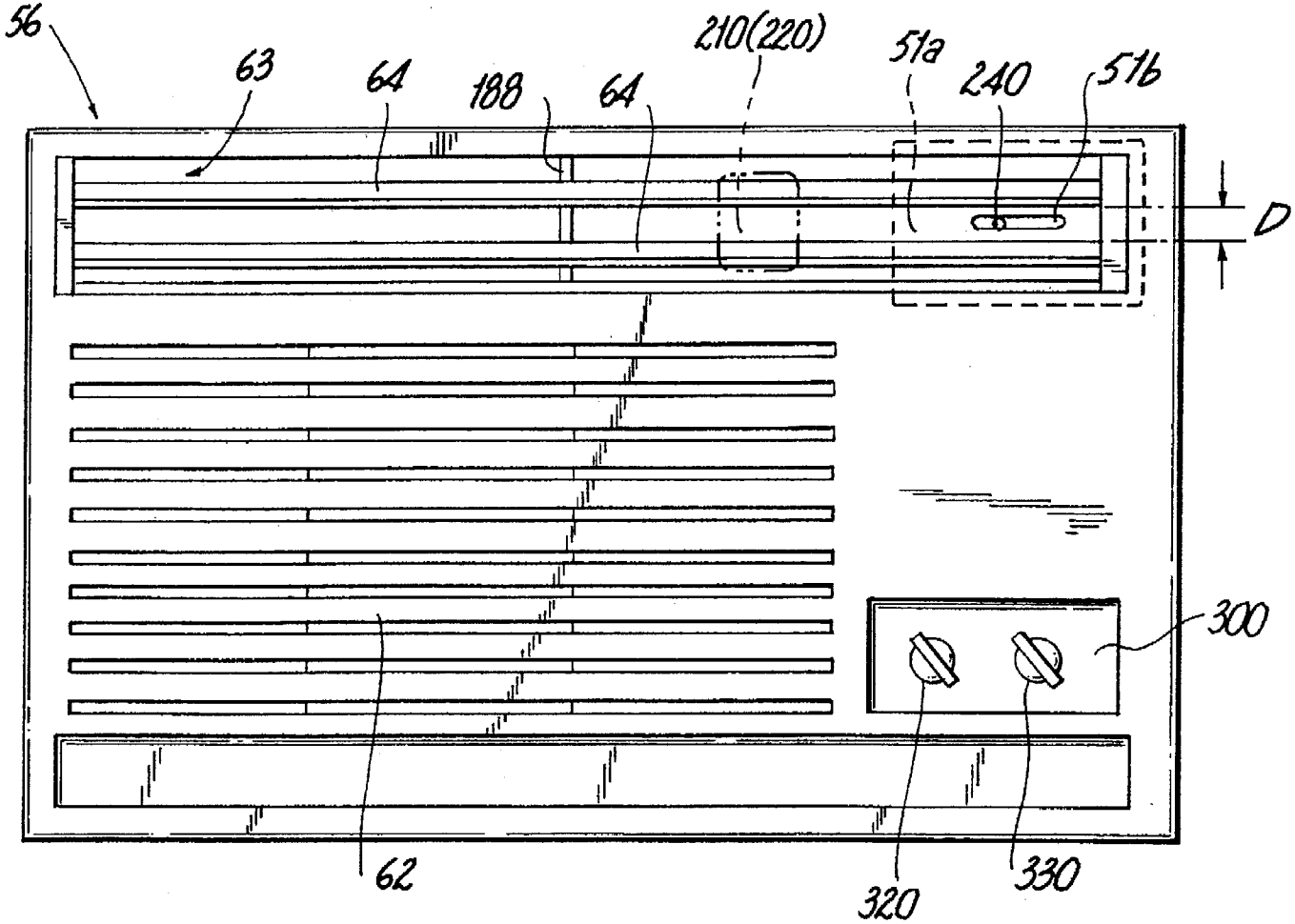
FIG. 14 is a front view of the air conditioner.

Further, in this embodiment, as described later in more detail, the dimension D of a gap between the lateral blades 64 is set to be large so that a finger (fingers) can be inserted into the gap to move an open/close operation member 240 in a direction as indicated by an arrow R as shown in FIG. 14.

Figure 8:
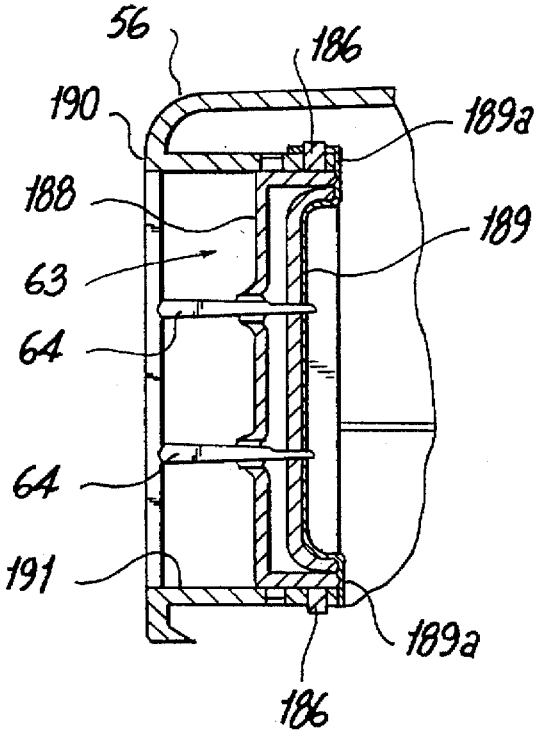
FIG. 8 is a cross-sectional view of the front panel which is taken along a line 8—8 in FIG. 6.

FIG. 8 is a cross-sectional view which is taken along a line 8—8 of FIG. 6, and shows a mount structure of the lateral blades 64 in the air supply opening 63 of the front panel 56.

As shown in FIG. 8, the air supply opening 63 of the front panel is defined by an air blow-off opening upper edge portion 190 and an air blow-off opening lower edge portion 191. The lateral blades 64 are fixed at the center portion of the air supply opening 63 by first and second lateral blade support members 188 and 189. The first lateral blade support member 188 is formed of synthetic resin or the like and designed in an angularly U-shaped form, and has a projection 186 at each of upper and lower end faces thereof. Further, the first lateral blade support member 188 is provided with upper and lower recess grooves 187 on the front surface thereof as shown in FIG. 6.

The second lateral blade support member 189 is formed of metal or the like, and it is designed in an U-shaped form having inverted U-shaped edges which extend forwardly to the front panel as shown in FIG. 8, that is, it is designed in a sequential form of "S-shape", "U-shape" and "S-shape" as a whole. As described above, both the end portions 189*a* of the second lateral blade support member 189 are bent in an U-shaped fashion, and the edge of each end portion is designed in a forked shape as shown in FIG. 6.

If the air blow-off opening is designed to be long, the air blow-off opening upper edge portion 190, the air blow-off opening lower edge portion 191 or the lateral blades 64 may be warped when heated air is blown off from the air supply opening 63. According to this embodiment, in order to prevent the warp, the central portions of the respective lateral blades 64 are engaged with the respective recess grooves 187 of the first lateral blade support member 188, and the upper and lower projections 186 of the first lateral blade support member 188 are engagedly inserted into holes 190*a* and 191*a* of the air supply opening lower edge portion 191 as shown in FIG. 6. Thereafter, the second lateral blade support member 189 is superposed on the first lateral blade support member 188 so that both the fork-shaped ends 189*a* of the second lateral blade support member 189 are engaged with the projections 186 of the first lateral blade support member 189 in a state where the projections 186 projects through the holes 190*a* and 191*a* as shown in FIG. 8. With this construction, the central portion between the air supply opening upper edge portion 190 and the air supply opening lower edge portion 191 can be firmly fixed by the first and second lateral blade support members 188 and 189, and also the center portions of the lateral blades 64 can be firmly fixed by the members 188 and 189. Therefore, even when the heated air is blown off from the air supply opening 63, the air supply opening upper edge portion 19, the air supply opening lower edge portion 191 or the lateral blades 64 can be prevented from being warped due to the heat. Accordingly, the lateral blade mount structure in the air supply opening can be made firm.

According to the assembly of the first and second lateral blade support members as described above, one of the first and second lateral blade support members 190 and 191 (the first lateral blade support member 190 in this embodiment) is formed of synthetic resin, and the other member (the second lateral blade support member 191) is formed of metal, so that the total weight of the assembly is reduced because a part of the assembly is formed of synthetic resin, and the entire mechanical strength thereof is enhanced because the other part is formed of metal.

Referring to FIG. 2, the partition plate 6 is formed with the opening 210 through which the outside air is selectively supplied from the outside into a room. For this type of air conditioners, it is generally required that the outside air should be supplied from the outside into the room if occasion demands, and thus such an opening through which the outside air is introduced into the room is provided to the partition plate between an indoor side heat exchanging unit and an outdoor side heat exchanging unit.

Figure 9:
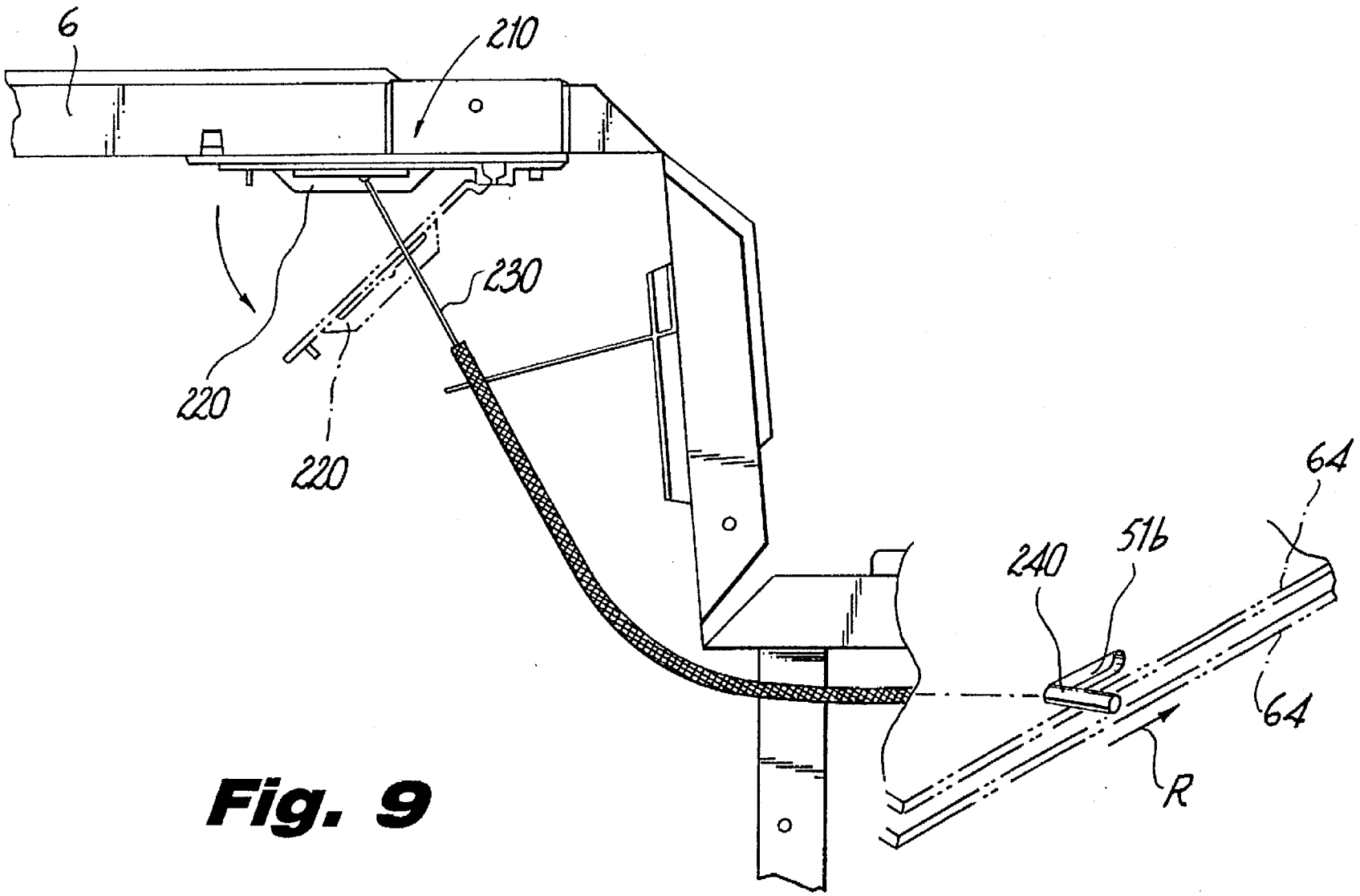
FIG. 9 is a top view showing an outside air intake opening portion and a closing member for the opening portion in the air conditioner.
Figure 10:
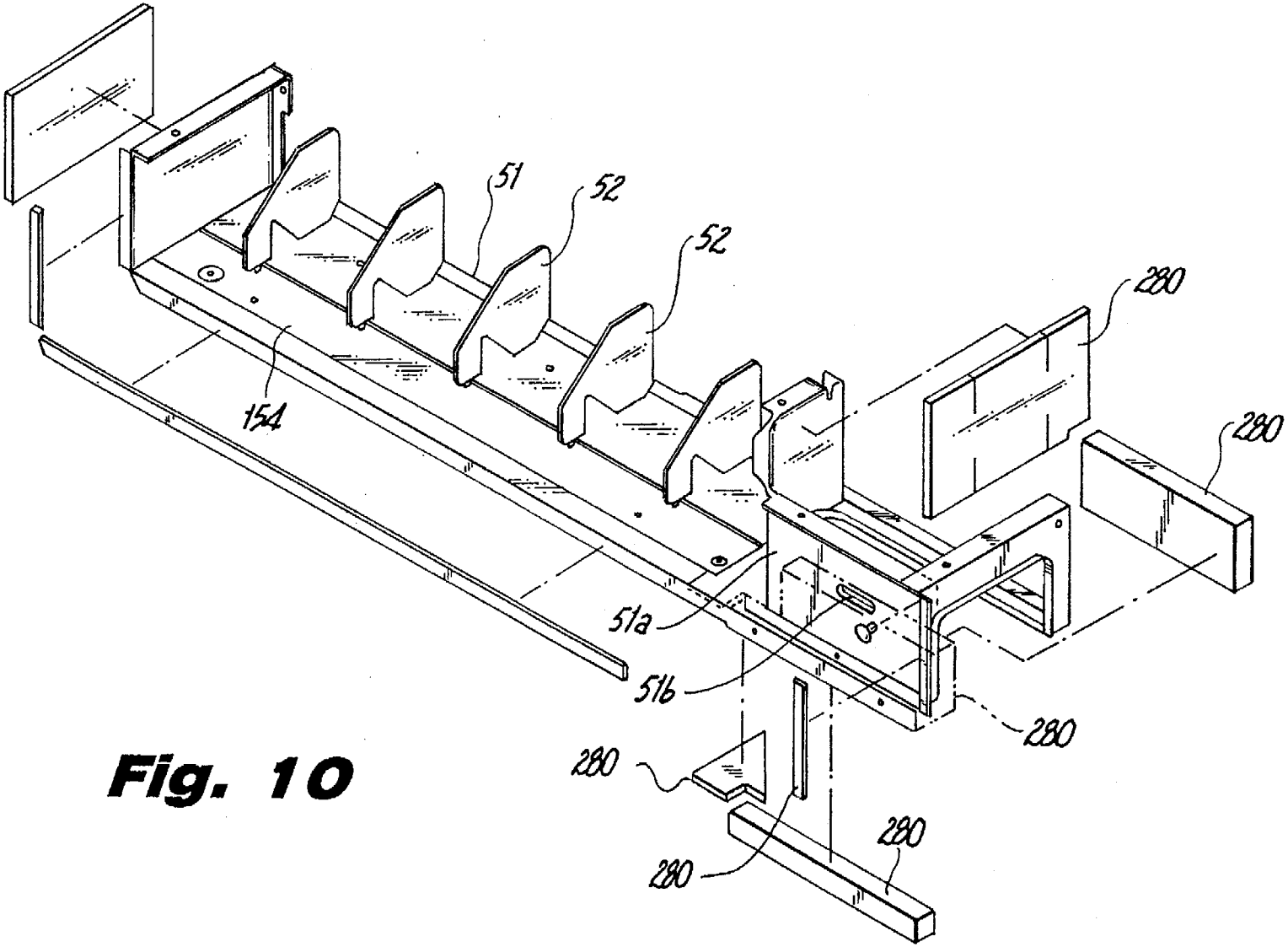
FIG. 10 is a diagram showing an air blow-off member at the air blow-off vent.

The opening 210 is freely (selectively) closed by a closing member such as a damper 220 as shown in FIG. 9. The closing member 220 is linked to one end of a wire 230, and the other end of the wire 230 is linked to the open/close operation member 240 as shown in FIG. 2. In this embodiment, an operation portion or plate 51*a* having a slit 51*b* is fixed to a suitable portion of the body near to the front panel (for example, the frame of the air supply member 51 as shown in FIG. 10), and the open/close operation member 240 is provided to the operation portion so as to be movable through the slit 51*b* in a direction as indicated by an arrow R as shown in FIGS. 2, 9 and 10. When the open/close operation member 240 is moved in the direction R, the closing member 220 is swung through the wire 230 in a direction as indicated by an arrow R' in FIG. 9 so that its operation state is changed from a closing state as indicated by a solid line to an opening state as indicated by a two-dotted chain line, whereby the opening 220 is opened and the outside air is supplied from the outside into the room.

The open/close operation member 240 is secured to the operation portion 51*a* so that it is located between the lateral blades 64 as shown in FIGS. 9 and 14 when the front panel 56 shown in FIG. 6 is mounted on the body 1 shown in FIG. 2. Since the open/close operation member 240 is located at the gap between the lateral blades 64, the open/close operation member 240 can be manipulated easily, but not very easily, by inserting a finger (fingers) into the gap between the lateral blades 64. It is not preferable that the open/close operation of the closing member 220 is frequently performed by everyone, and it is sufficient for only a building manger to perform it. That is, it is unnecessary to manipulate the open/close operation member frequently.

According to this embodiment, the open/close operation member 240 is located at the gap between the lateral blades 64, and thus it is not easily found out from the outside of the front panel 56. Therefore, only a person who know the position of the open/close operation member 240, such as a building manager, can manipulate the open/close operation member 240, and the manipulation of the open/close operation member 240 can be easily performed without detaching the front panel 56 from the body 1 by inserting his finger into the gap between lateral blades 64.

Further, the body 1 has a space in which an electric parts box 60 is disposed. In this embodiment, the electric parts box 60 is disposed at the right lower side of the body 1. As described later, a cable winding room 250 for leading a power cable is provided between the back surface 60*a* of the electric parts box 60 and a shielding portion 6*a* of the partition plate 6, and an accommodation room 60 for the power cable C is provided at the upper side of the upper surface 60*b* of the electric parts box 60.

Figure 11:
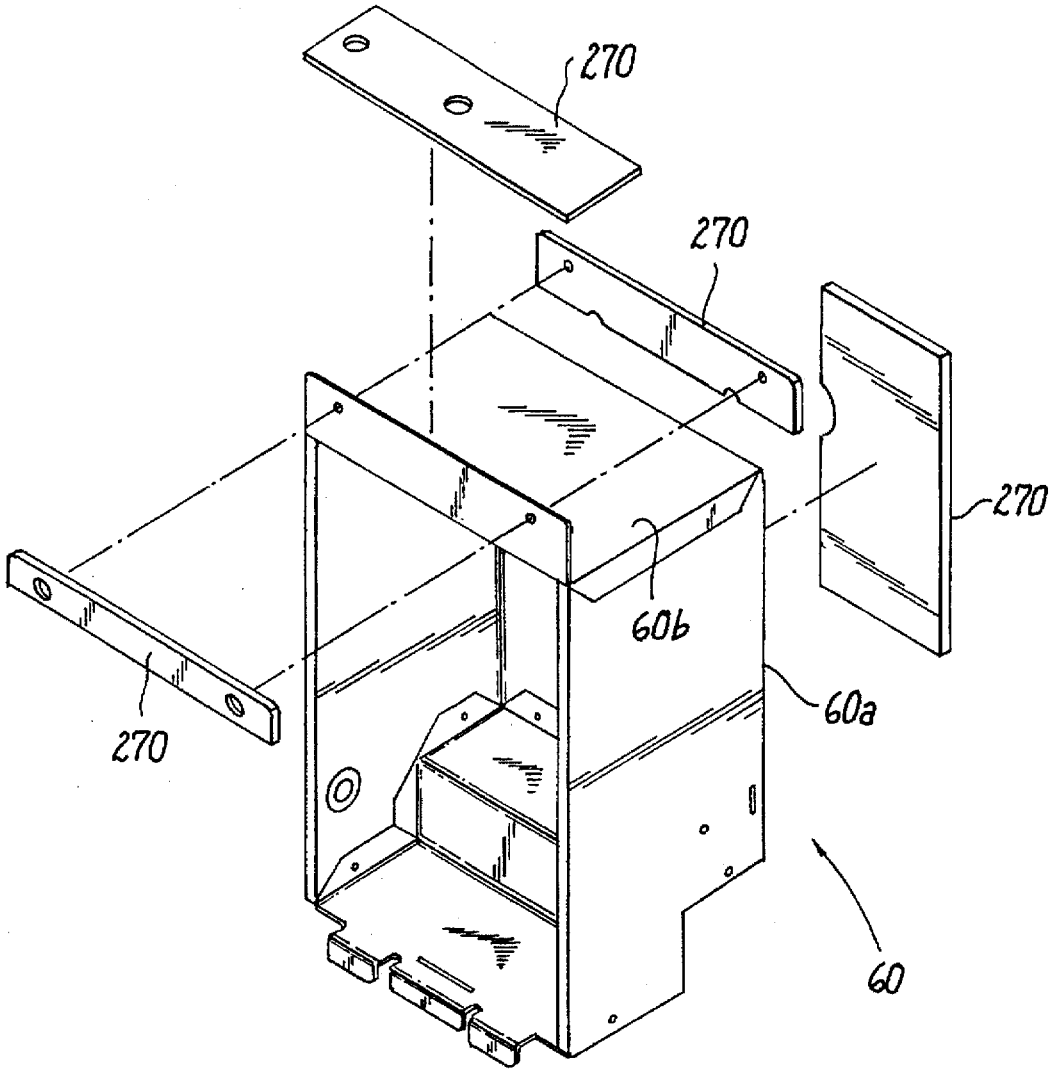
FIG. 11 is an exploded perspective view of an electronic parts box.
Figure 12:
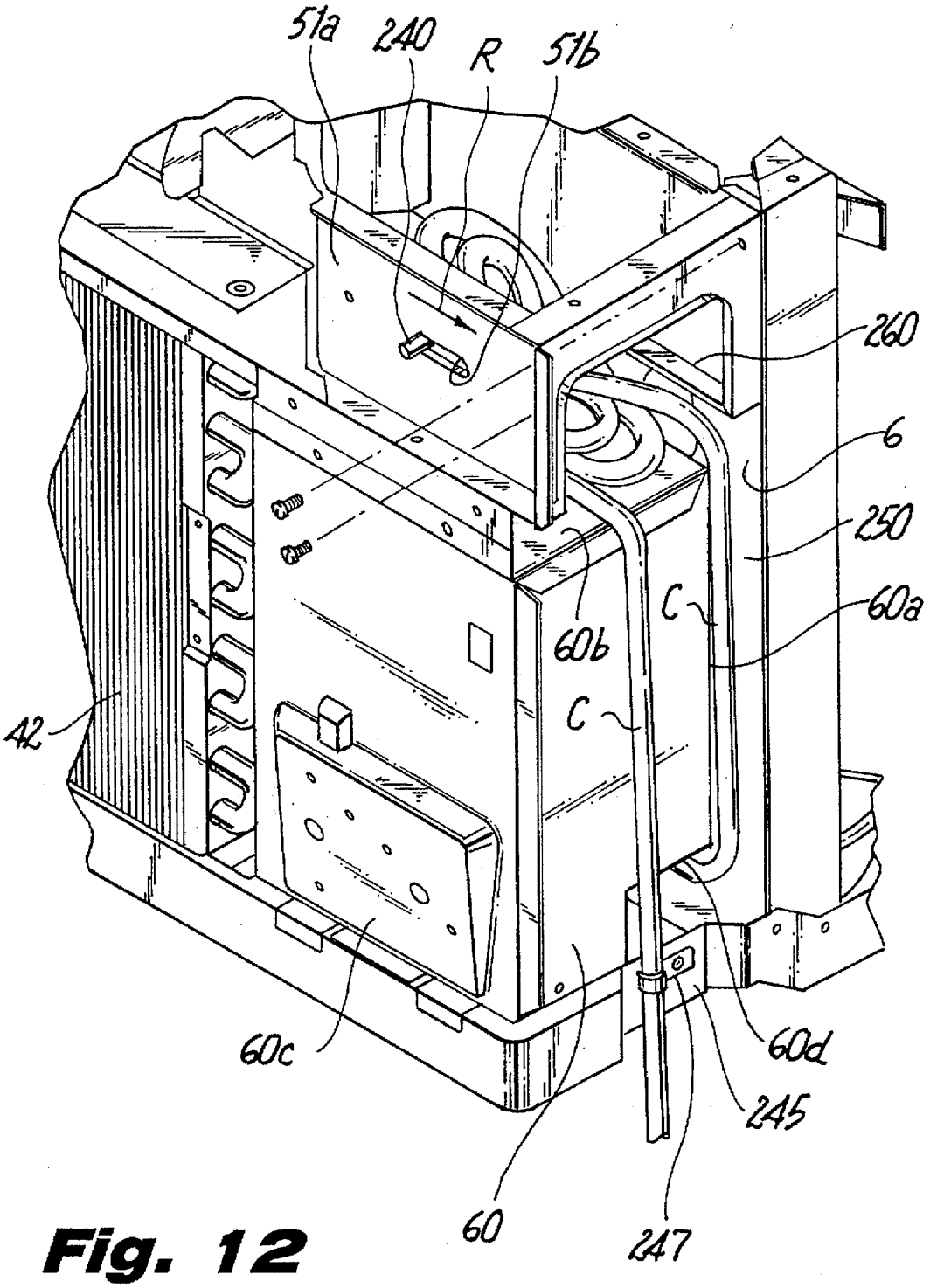
FIG. 12 is a perspective view of the electronic parts box.

A packing 270 is attached to the back surface 60*a* of the electric parts box 60 as shown in FIG. 11, and a packing 280 is attached to the inner surface of the operation portion 51*a* at the upper surface 60*b* side of the electric parts box 60 as shown in FIG. 10. The packings 270 and 280 are used to prevent the power cable C from being damaged when the power cable C is accommodated in the cable winding room 250 and the accommodation room 260.

The power cable C is beforehand designed to be long, and thus a part of the power cable C is necessarily left over. Therefore, the surplus part of the power cable C is led out from the lower surface 60*d* of the electric parts box 60 to the back surface 60*a* of the electric parts box 60, wound up at many times in the cable winding room 250 in accordance with the length of the surplus part of the cable C, and then accommodated in the accommodation room 260. Thereafter, the cable C is led downwardly from the accommodation room 260 along the side surface of the electric parts box, and fixed to the side wall 245 of the bottom portion thereof through a fixing member 247. With this fixing arrangement, the surplus part of the power cable C after a cable connection work can be effectively accommodated in the accommodation room 260 without being damaged.

Further, since the cable winding room 250 is provided on the back surface 60*a* of the electric parts box 60, a space is formed there. Accordingly, even when dew occurs on the partitioning plate 6, no dew sticks to the electric parts box 60, so that insulation of electric parts in the electric parts box 60 can be promoted.

Figure 13:
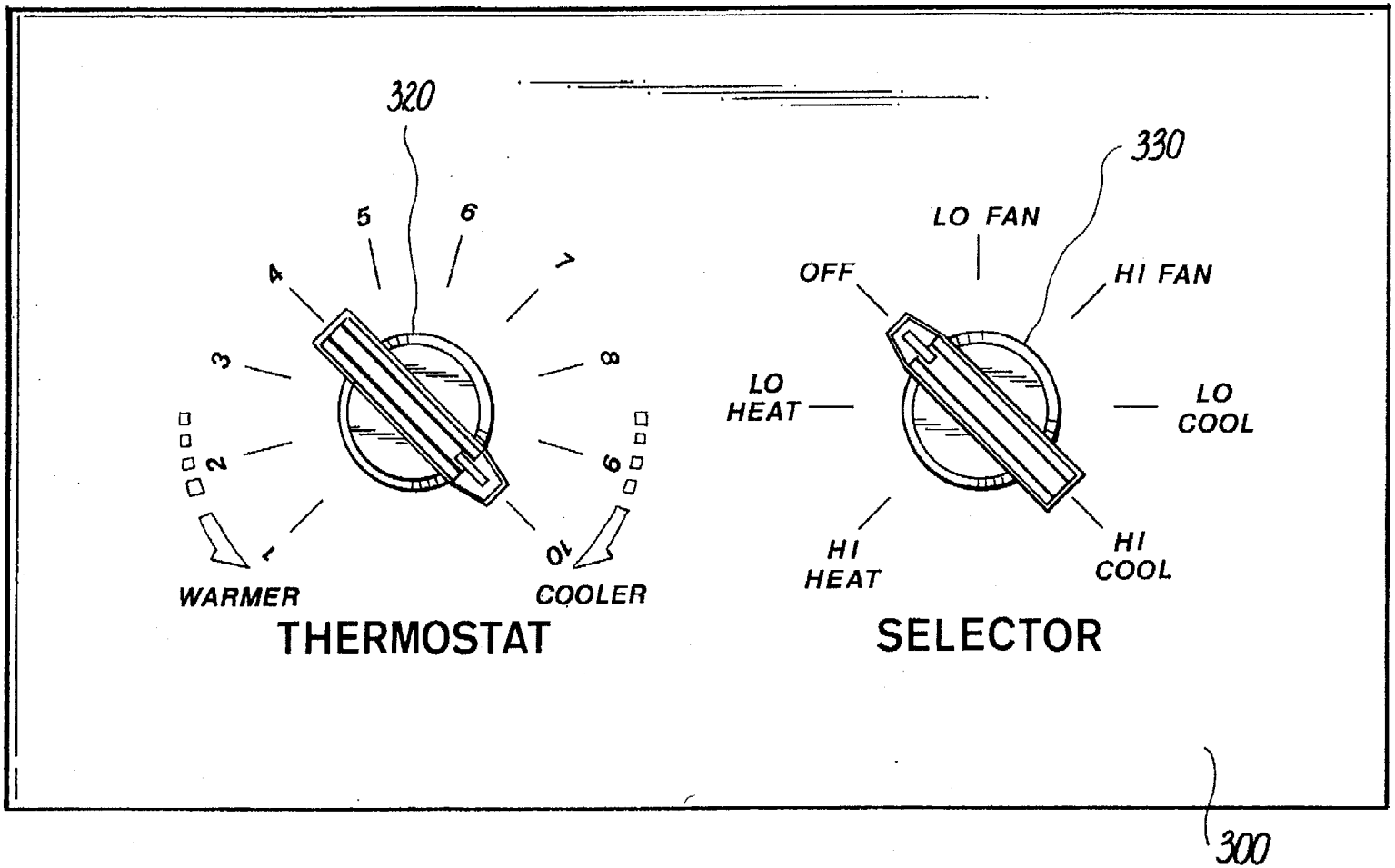
FIG. 13 is a plan view showing an operation panel.

FIG. 13 is a plan view showing an operation panel 300. The operation panel 300 is disposed on the front surface 60*c* of the electric parts box 60 of FIG. 2 so as to be exposed to an opening 310 of the front panel 56 of FIG. 6. The operation panel 300 has a thermostat 320 and a selector 330.

The present invention is not limited to the above embodiment, and various modifications may be made without departing from the subject matter of the present invention. For example, the above embodiment uses two lateral blades 64, however, it may use one lateral blade, or three or more lateral blades. That is, any number of lateral blades 64 may be used. Further, as the open/close operation member may be used a mechanical operating member such as a lever, a rod, a pin or the like, or an electrical switch. In this case, the open/close operation member is required to be disposed so that it can be operated easily by inserting a finger (fingers) between the lateral blades, but it cannot be easily found out from the outside of the front panel.

According to the air conditioner of the present invention, the outside air supply opening portion can be opened to supply the outside air into the room by inserting fingers through a gap between the plural air-flow direction changing blades to manipulate the open/close operation member (to move the open/close operation member in the horizontal (lateral) direction). Therefore, the outside air supply work can be simply performed without detaching parts such as a front panel, etc. from the air conditioner. In addition, the open/close operation member is disposed not to be easily noticed, so that it can be prevented from being easily handled by everybody. Therefore, an user can be prevented from carrying out an undesired open/close operation.

What is claimed is:

1. An air conditioner having a body, a front panel facing a room, plural air-flow direction changing blades provided at an opening of said front panel, and a path for supplying the outside air into said opening, including:

an open/close operation member which is provided to an operation portion of said body as to be manipulated through a gap between said air-flow direction changing blades from the room; and a closing member which is linked to said open/close operation member and serves to selectively open or close said path in accordance with an operation state of said open/close operation member.

2. The air conditioner as claimed in claim 1, wherein said operation portion has a slit which is formed in said operation portion so as to extend in a direction along said gap, and said open/close operation member is designed to project forwardly through said slit of said operation portion and to be slidable along said slit, wherein said path is selectively opened or closed through said closing member by manipulating said open/close operation member from the room through the gap between said air-flow direction changing blades.

3. The air conditioner as claimed in claim 2, wherein said open/close operation member comprises an operation rod which is secured to said operation portion so as to be reciprocatively movable along said slit of said operation portion, and a wire having one end linked to said operation rod and the other end linked to said closing member, wherein said rod is operated in a direction along said gap from the outside through the gap between said plural air-flow direction changing blades and the horizontal operation of said rod is transmitted to said closing member through said wire to perform a selective closing operation of said opening portion.

4. The air conditioner as claimed in claim 3, wherein said operation rod is slidable horizontally.

5. An air conditioner in which an indoor-side air conditioning portion including an indoor heat exchanger for performing heat exchange with an indoor side air, an indoor air-blowing fan for blowing the air into a room and a front panel having plural air-flow direction changing blades which are provided at an air opening and an outdoor-side air conditioning portion including an outdoor heat exchanger for performing heat exchange with an outdoor side air, a compressor for compressing refrigerant and an outdoor air-blowing fan for blowing off the outdoor side air to said outdoor heat exchanger, are integrally fabricated in an outer case, and the indoor-side air conditioning portion and the outdoor-side air conditioning portion are separately sectioned by a partitioning plate, including:

an outside air supply opening portion which is provided to said partitioning plate and serves to supply the air of said outdoor-side air conditioning portion into said indoor-side air conditioning portion;

an open/close operation member which is provided to an operation portion of said indoor-side air conditioning portion so as to confront said air opening of said front panel and so as to be manipulated from a room to be air-conditioned, through a gap between said plural air-flow direction changing blades; and a closing member which is linked to said open/close operation member and serves to selectively open or close said outside air supply opening portion in accordance with an operation state of said open/close operation member.

6. The air conditioner as claimed in claim 5, wherein said operation portion has a slit which is formed in said operation portion so as to extend in a direction along said gap, and said open/close operation member is designed to project forwardly through said slit of said operation portion and to be slidable along said slit, wherein said path is selectively opened or closed through said closing member by manipulating said open/close operation member from the room through the gap between said air-flow direction changing blades.

7. The air conditioner as claimed in claim 6, wherein said open/close operation member comprises an operation rod which is secured to said operation portion so as to be reciprocatively movable along said slit of said operation portion, and a wire having one end linked to said operation rod and the other end linked to said closing member, wherein said rod is operated in a direction along said gap from the outside through the gap between said plural air-flow direction changing blades and the horizontal operation of said rod is transmitted to said closing member through said wire to perform a selective closing operation of said opening portion.

8. The air conditioner as claimed in claim 7, wherein said operation rod is slidable horizontally.

* * * * *

UNITED STATES PATENT AND TRADEMARK OFFICE

CERTIFICATE OF CORRECTION

PATENT NO. : 5,687,583

DATED : Nov. 18, 1997

INVENTOR(S) : Syoji Tunekawa et al.

It is certified that error appears in the above-identified patent and that said Letters Patent is hereby corrected as shown below:

On the title page, item [75] Inventors, change "Ota" to --Ota-shi--.

Signed and Sealed this

Twenty-third Day of June, 1998

Bruce Lehman

*Attest:*

BRUCE LEHMAN

*Attesting Officer*

*Commissioner of Patents and Trademarks*